US006362714B1

(12) United States Patent
Rice et al.

(10) Patent No.: US 6,362,714 B1
(45) Date of Patent: Mar. 26, 2002

(54) MULTI-PART REACTIVE DEVICE AND METHOD

(75) Inventors: Amy Rice, Evanston; Mitchell Budniak, Highland Park; Nick Hopman, Lake Zurich, all of IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/345,619

(22) Filed: Jun. 30, 1999

(51) Int. Cl.[7] ..... H01F 27/08
(52) U.S. Cl. ..... 336/179; 336/200; 336/61
(58) Field of Search ..... 336/55, 61, 200, 336/223, 232, 179; 361/270

(56) References Cited

U.S. PATENT DOCUMENTS 4,103,267 A * 7/1978 Olschewski ..... 336/65
5,430,613 A * 7/1995 Hastings et al. ..... 361/760
5,959,846 A * 9/1999 Nuguchi et al. ..... 361/782

* cited by examiner

*Primary Examiner*—Lincoln Donovan
*Assistant Examiner*—Tuyen Nguyen
(74) *Attorney, Agent, or Firm*—Nicholas C. Hopman; Kenneth D. Labudda; Steven A. May

(57) ABSTRACT

A multi-part reactive device preferably includes a substrate with a first conductive area and a second conductive area. A first conductive element with a first terminal is connected to the first conductive area. The first conductive element has a second terminal connected to the second conductive area. A current loop is formed extending from the first conductive area, through the first terminal, through the second terminal, to the second conductive area. A magnetically-effective core member is captivated by the first conductive element to the substrate between the first conductive area and the second conductive area and encircles the current loop. The first conductive area, the first conductive element, the magnetically-effective core member, and the second conductive area form a first magnetic circuit. Additional magnetic circuits can be formed by adding additional conductive patterns and additional conductive elements.

13 Claims, 5 Drawing Sheets

MULTI-PART REACTIVE DEVICE AND METHOD

FIELD OF THE INVENTION

The present invention relates generally to electronic circuit components, and more particularly, to an inductor. The described device is particularly useful in high-power and/or high frequency applications, both in surface-mount and through-hole configurations.

BACKGROUND OF THE INVENTION

Modern electronic products are constructed from electronic circuit components interconnected to perform a desired function. Among the various types of electronic components used in electronic products are coil-type devices such as inductors and transformers. High power inductors and transformers are used to transform power in, for example, electronic switching applications, and to filter signals and isolate noise in electronic applications. These inductors are often found in automotive applications that have a severe vibration environment. Moreover, inductors in automotive applications are typically deployed in power management circuits and actuator driver circuits that demand high power resulting in relatively high power dissipation. Also, small physical size is imperative to fit into increasingly compact mounting areas.

Conventional inductors typically consist of wire wrapped around a magnetically-effective core device, such as an E-frame. For high power applications, a relatively large gauge wire is required. Mounting large gauge wire based inductors onto a circuit substrate is difficult, particularly on surface-mount substrates. Moreover, the available contact area between a surface mount substrate and a large gauge wire is relatively small, making power dissipation from the inductor's wire through the circuit substrate inefficient.

Fabricating high-power inductors using conventional techniques is also difficult because special winding machines need to be used. Moreover inductors fabricated using these machines often include extra parts to aid assembly.

Thus, there is a need for a high-power, high-frequency inductor packaged for surface mounting. The device must provide mechanical mounting sufficient to withstand vibration intensive environments and to dissipate heat generated during use. The device must also reduce sensitivity to skin effect at higher frequencies without the need for specialized wire or windings.

DETAILED DESCRIPTION OF THE PREFERRED EMBODIMENT

A multi-part reactive device preferably includes a substrate with a first conductive area and a second conductive area. A first conductive element has a first terminal connected to the first conductive area, and a second terminal, connected to the second conductive area. A current loop is formed extending from the first conductive area, through the first terminal, through the second terminal, to the second conductive area. A magnetically-effective core member is captivated by the first conductive element to the substrate between the first terminal and the second terminal and encircles the current loop. The first conductive area, the first conductive element, the magnetically-effective core member, and the second conductive area form a first magnetic circuit 124. Other variations of the basic structure are detailed in further embodiments. These include additional series-connected current loops, or current-carrying circuits, that captivate and are encircled by the magnetically-effective core member. Additionally, other components such as capacitors can be inserted at a junction of the series-connected current-carrying circuits to construct a more complex reactive device useful in filtering applications.

Figure 1:
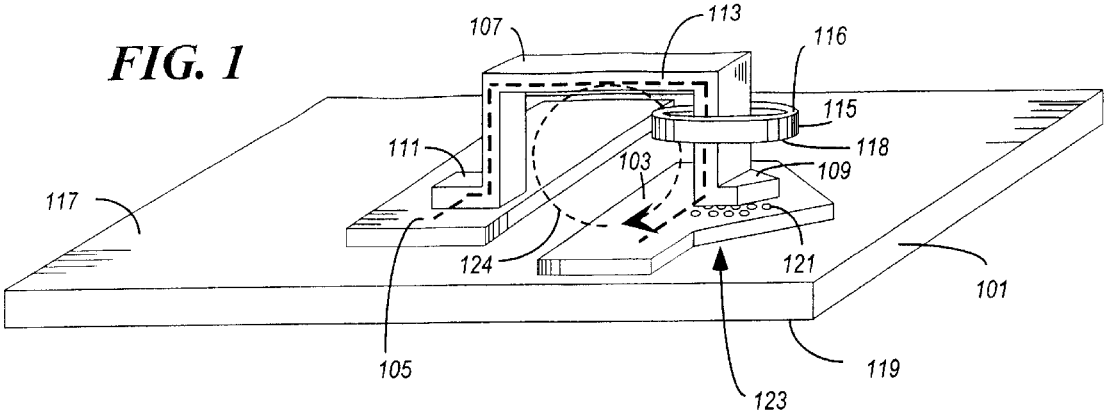
FIG. 1 is an isometric view of a multi-part reactive device in accordance with an embodiment of the invention.

FIG. 1 is an isometric view of a multi-part reactive device in accordance with a preferred embodiment of the invention. A substrate 101 has a first conductive area 103 and a second conductive area 105 disposed thereon. A first current loop 113 is formed around a first current-carrying circuit extending from the first conductive area 103, to a first terminal 109 of a first conductive element 107, to a second terminal 111 connected to the second conductive area 105. A first magnetic circuit 124 is formed including a magnetically-effective core member 115 that is captivated by the first conductive element 107 to the substrate 101 between the first conductive area 103 and the second conductive area 105 and encircling the first current loop 113. The magnetically-effective core member 115 may be constructed of many geometries including a doughnut shape, or even a rectangular beam depending on the packaging and performance requirements of a particular design. The substrate 101 can be formed using various materials including FR4, ceramic, plastic, polyamide or other substantially electrically insulating material. The conductive areas 103 and 105, and the first conductive element 107, can be any electrically conductive material such as copper. The magnetic core member is preferably ferrite based. In FIG. 1 the first conductive element 107 is a surface-mountable component. Although the surface mount structure is not required it has some benefits—particularly a simpler assembly process.

Describing another structural feature, the substrate 101 has a major surface 117 and an opposing major surface 119.

At least one via 121, and preferably an array of vias are disposed through the substrate 101, connecting the major surface 117 to the opposing major surface 119. The vias coincide with a portion 123 of the first conductive area 103 at a position in contact with the first terminal 109. The vias 121 are in place to conduct heat away from the first terminal 109 of the first conductive element 107. This structure is particularly useful in application where a high current is passed through the first current-carrying circuit. The described arrangement is very useful because the first conductive element 107 can be easily fabricated out of a stamped piece of metal and have a relatively high current-carrying capability.

Figure 2:
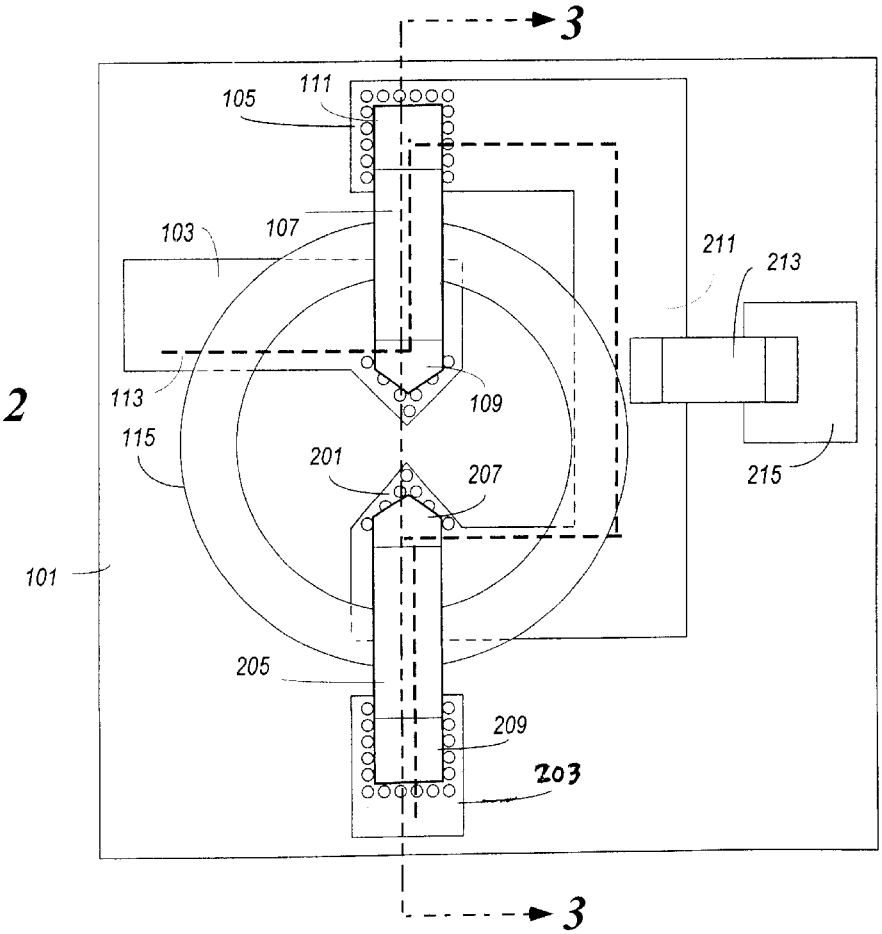
FIG. 2 shows a plan view of a multiple current loop device extending the essential structure disclosed in FIG. 1.

FIG. 2 is a plan view of a multiple current loop device extending the essential structure disclosed in FIG. 1.

Elements 101, 103, 105, 107, 109, 111, and 115 are repeated from FIG. 1 for reference. The substrate 101 has a third conductive area 201 extending apart from the second conductive area 105. The particular geometry shown is conducive to building a second current loop around the magnetically-effective core member 115. A fourth conductive area 203 is disposed on the substrate 101 and is electrically isolated from the first conductive area 103 and the second conductive area 105. A second conductive element 205 has a third terminal 207 connected to the third conductive area 201 and a fourth terminal 209 connected to the fourth conductive area 203. The first currentcarrying circuit is now extended forming a combined current carrying circuit from the second conductive area 105, to the third conductive area 201, through the third terminal 207, through the fourth terminal 209, to the fourth conductive area 203. The magnetically-effective core member 115 is captivated by the second conductive element 205 to the substrate 101 between the third terminal 207 and the fourth terminal 209 and encircles the first current loop 113 a second time forming a second series-connected current loop. The third conductive area 201, the second conductive element 205, the magnetically-effective core member 115, and the fourth conductive area 203 form a second magnetic circuit 303, shown in FIG. 3, coupled to the first magnetic circuit 124. By adding the second current loop in series with the first current loop 113 the combined current carrying circuit will exhibit a higher inductance.

Figure 3:
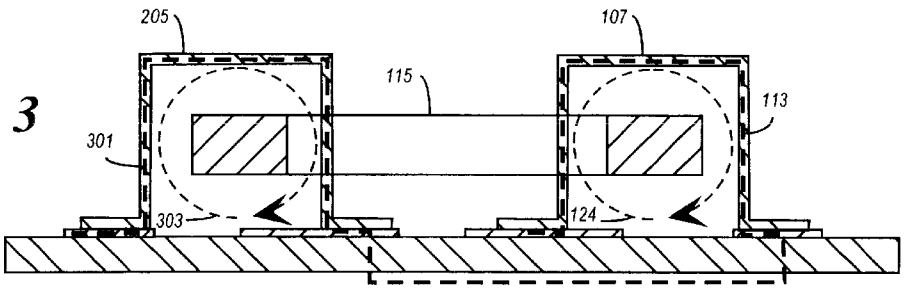
FIG. 3 illustrates a cross-sectional view of the multiple current loop device shown in FIG. 2.

FIG. 3 illustrates a cross-sectional view of the multiple current loop device shown in FIG. 2. In this figure the second current loop 301 is shown. As mentioned above, the combined first current carrying circuit and the second current carrying circuit form a first current loop 113 and a second current loop 301 both encircling the magnetically-effective core member 115. The second current loop 301 allows the formation of a second magnetic circuit 303.

Figure 4:
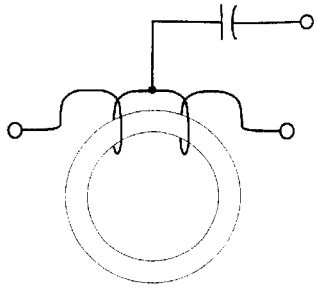
FIG. 4 is a schematic of a multi-part reactive device in accordance with an embodiment of the invention.

"Often it is desirable to form a complex inductive circuit to more effectively filter electrical signals. FIG. 4 illustrates such a circuit with the two-turn inductor described above with a capacitor located at the junction of the two turns. Physical construction of this device can be seen in FIG.2. Returning to FIG. 2, a fifth conductive area 211 is located on the substrate 101 electrically isolated from the first conductive area 103, and it extends between the second conductive area 105, and the third conductive area 201, and a sixth conductive area 215 is located on the substrate 101 electrically isolated from the fifth conductive area 211. A capacitor 213 is connected between the fifth conductive area 211 and the sixth conductive area 215. This design allows the construction of multiple component filters using conventional surface-mount components."

Figure 5:
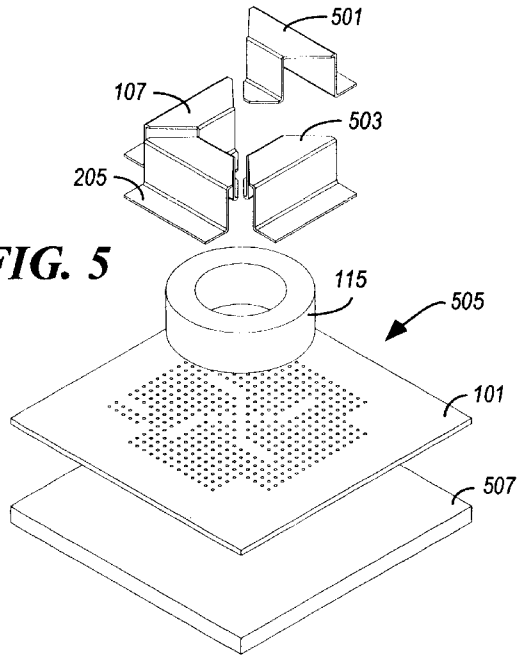
FIG. 5 shows an exploded isometric view of a multi-part reactive device in accordance with an embodiment of the invention.

FIG. 5 shows an exploded isometric view of a multi-part reactive device in accordance with an embodiment of the invention. More specifically, elements 107, 205, 501, and 503 combined with the circuit pattern on the substrate 101 form a four-turn inductor. The substrate 101 can be mounted onto a metal plate 507 with an electrically insulating adhesive to conduct heat generated by resistive losses in the elements 107, 205, 501, and 503 to the metal plate 507. Note that as in the previous examples the magnetically-effective core member 115 is captivated between the circuit pattern on the substrate and the elements 107, 205, 501, and 503. It can be easily seen that higher-order inductors can be built using this basic construction.

Figure 6:
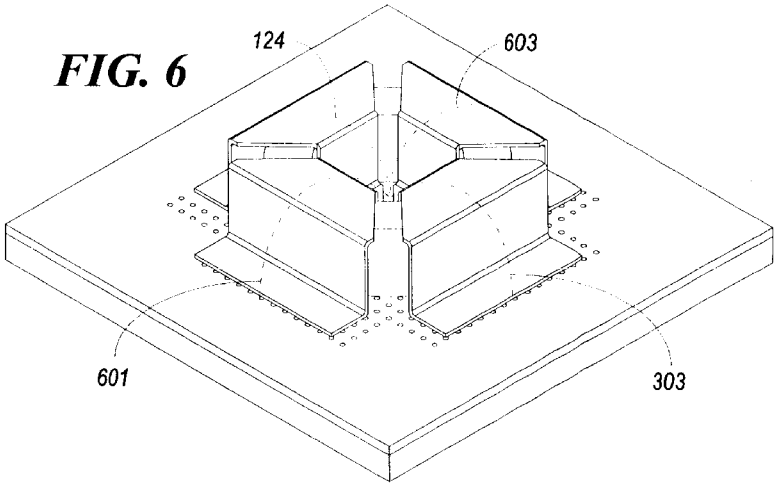
FIG. 6 illustrates an isometric view of a multi-part reactive device shown in FIG. 5.

FIG. 6 illustrates an isometric view of a fully assembled multi-part reactive device shown in FIG. 5. Here four magnetic circuits are formed 124, 303, 601, 603, the two new ones by adding additional conductive patterns and additional conductive elements.

Figure 8:
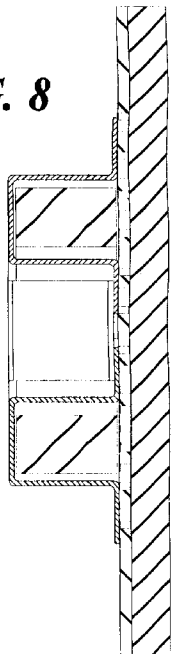
FIG. 8 shows a cross-sectional view of the multi-part reactive device shown in FIG. 7.
Figure 7:
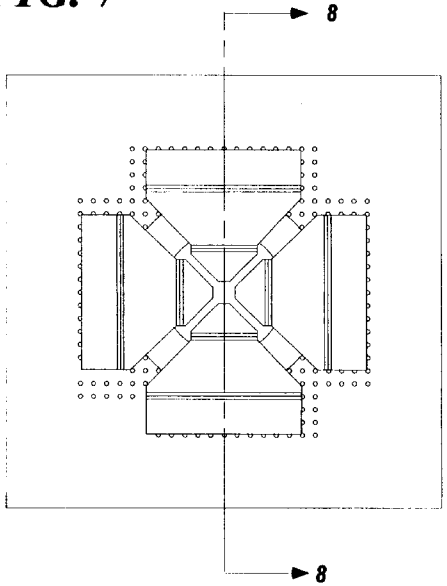
FIG. 7 is a plan view of the multi-part reactive device shown in FIG. 6.

FIG. 7 is a plan view of the multi-part reactive device shown in FIG. 6, and FIG. 8 shows a cross-sectional view of the multi-part reactive device shown in FIG. 7.

Figure 9:
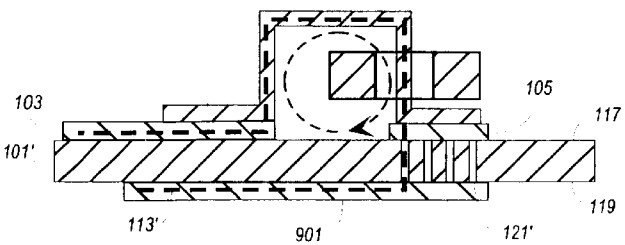
FIG. 9 illustrates a cross-sectional view of another embodiment of the multi-part reactive device.

FIG. 9 illustrates a cross-sectional view of another embodiment of the multi-part reactive device. In this embodiment metal trace patterns are located on both major surfaces 117 and 119 of the substrate 101'. Here the second conductive area 105 is extended through the substrate with a via pattern 121' to a conductive trace 901. Note that the conductive trace 901 extends coincident with the first conductive area 103. This arrangement enables the magnetically-effective core member to be more effectively encircled by the first current loop 113' which makes for a more efficient, or less lossy, magnetic circuit.

Figure 10:
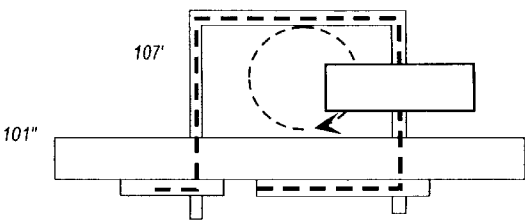
FIG. 10 is a cross-sectional view of another embodiment of the multi-part reactive device.

FIG. 10 is a cross-sectional view of another embodiment of the multi-part reactive device. In this embodiment the substrate 101" is of the double-sided through-hole type, and an alternative first conductive element 107' is inserted through the substrate 101" rather than resting on one side as in the previous embodiments. This is an alternative for use with through-hole component technology.

Figure 11:
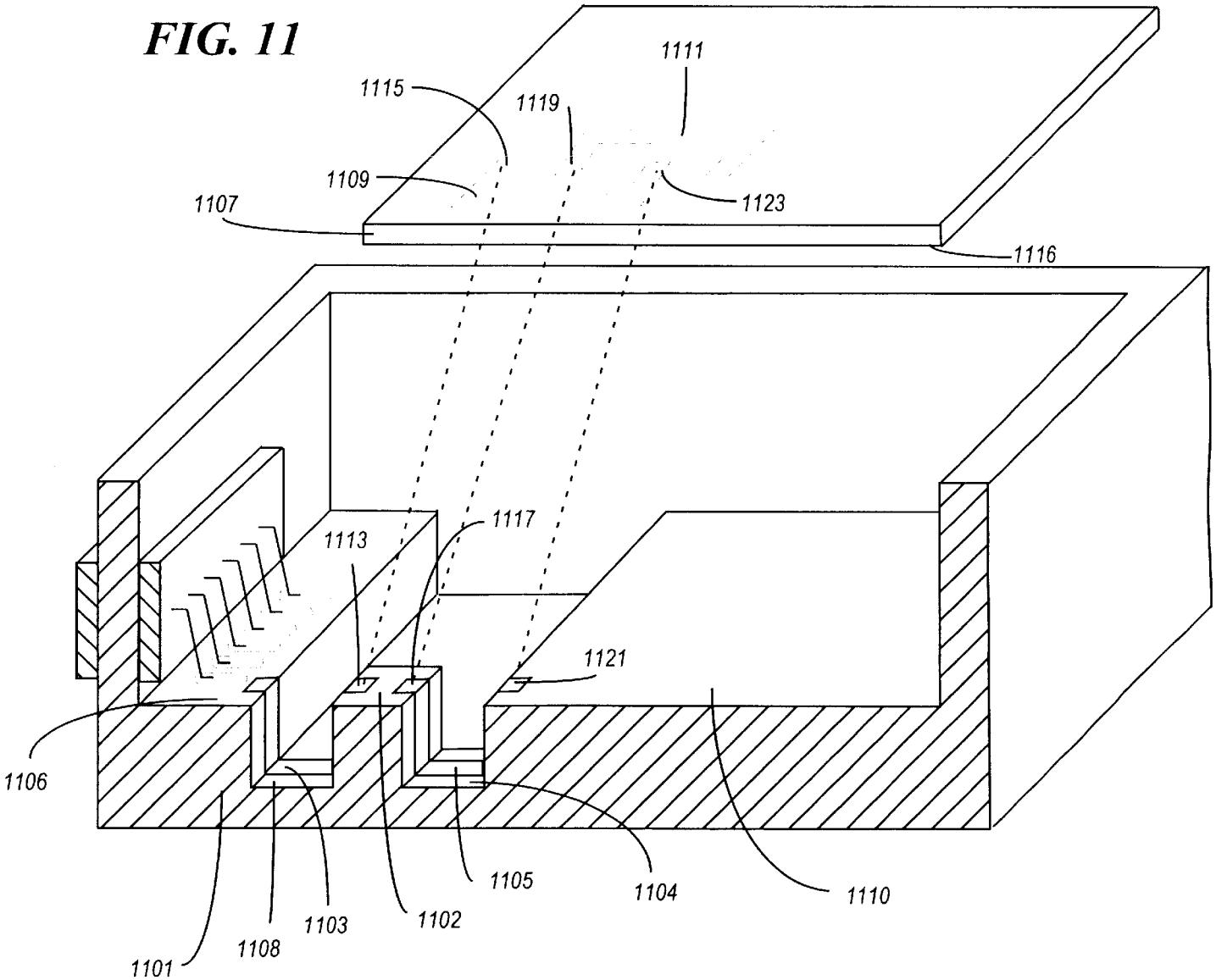
FIG. 11 shows an isometric view of another embodiment of a multi-part reactive device.

FIG. 11 shows an isometric view of another embodiment of a multi-part reactive device. In this embodiment the previously introduced substrate 101 is replaced by a plate-able thermoplastic housing. The housing consists of a base portion 1101 and a cover portion 1107. Each portion 1101, 1107 has an electrically conductive circuit pattern 1103, 1105 and 1109 and 1111 respectively disposed thereon. These plate-able thermoplastic structures are also known as moldable printed circuit boards. Molded printed circuit boards can be fabricated using what is commonly referred to as two-color plastic. In this type of structure the two plastics are sequentially molded into an appropriate shape to hold the circuit components. One of the two plastic materials can be plated with metal that, once soldered, acts to physically captivate and electrically connect circuit components.

An attribute of the two-color plastic process is that it can be used to construct housings for affixing and enclosing components including other substrates. In fact, a substrate and the housing can be fabricated as one physical part, rather than two separate components. This type of structure is often referred to as a Molded Interconnect Device (MID). What's interesting here is that a multi-part reactive device can be constructed with only a plated housing and a magnetically-effective core member. The electrically conductive circuit patterns 1103 and 1105 replace the conductive elements, such as element 107 in the embodiment shown in FIG. 1. Note that, as in the case of the initial embodiment shown in FIG. 1 the circuit pattern 1103, 1105 could be contained on only the base portion of the housing 1101.

More specifically the base portion of the molded thermoplastic device 1101 has a first conductive area 1103 disposed extending from a first surface 1102 to a fourth surface 1108 positioned apart from the first surface 1102, and a second conductive area 1105 disposed extending from the first surface 1102 to a second surface 1104 positioned apart from the first surface 1102. The first conductive area 1103 and the second conductive area 1105 are electrically isolated. The cover portion 1107 of the molded thermoplastic device has a major surface 1116 with a third conductive area 1109 and a fourth conductive area 1111 disposed thereon. The third conductive area 1109 and the fourth conductive area 1111 are electrically isolated. The magnetically-effective core member 115 is captivated between the first surface 1102 and the second surface 1104 by the cover 1107. A first portion 1113 of the first conductive area 1103 is connected to a first portion 1115 of the third conductive area 1109 and a first portion 1121 of the second conductive area 1105 is connected to a second portion 1123 of the third conductive area 1109.

The base portion 1101 comprises a third surface 1106, a fourth surface 1108, and a fifth surface 1110. The first surface 1102, the third surface 1106, and the fifth surface 1110 are positioned in a substantially coplanar orientation, and the second surface 1104 and the fourth surface 1108 are also positioned in a substantially coplanar orientation.

"The first conductive area 1103 extends from the third surface 1106 to the fourth surface 1108 to the first surface 1102, and the second conductive area 1105 extends from the first surface 1102, to the second surface 1104, to the fifth surface 1110. The major surface 1116 of the cover portion 1107 abuts the third surface 1106, the fifth surface 1110, and the first surface 1102 of the first molded thermoplastic device 1101. A second portion 1117 of the second conductive area 1105 is connected to a second portion 1119 of the fourth conductive area 1111. Preferably the connections are effected using solder."

Figure 12:
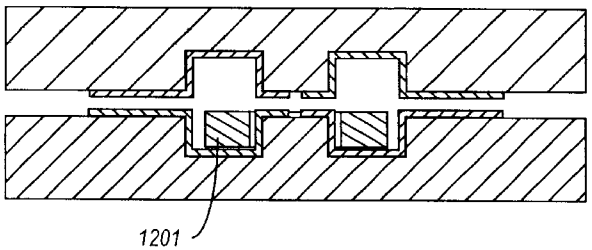
FIG. 12 illustrates a cross-sectional view of another embodiment of the multi-part reactive device.

FIG. 12 illustrates a cross-sectional view of another embodiment of the multi-part reactive device. In this illustration a magnetically-effective core member 1201 is captivated between two sections of a molded interconnect device. These two sections not only physically hold the magnetically-effective core member 1201 but also provide the windings of the inductor. Like the embodiment shown in FIG. 11 this is an elegant, simple to manufacture, and low cost method of manufacturing an inductor.

Figure 13:
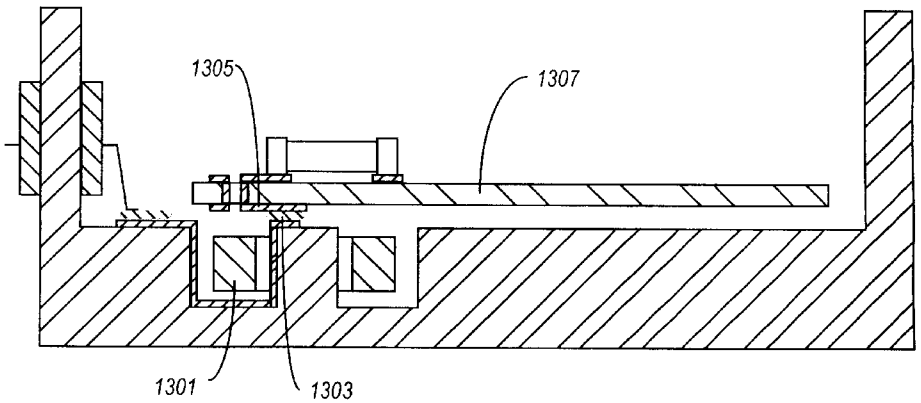
FIG. 13 is a cross-sectional view of another embodiment of the multi-part reactive device.

FIG. 13 is a cross-sectional view of another embodiment of the multi-part reactive device. In this figure a substrate is used both to captivate the magnetically-effective core member 1301 as well as complete the inductive circuit partially implemented in the molded interconnect device. Reference number 1303 shows a solder interconnection to a metal trace 1305 on the substrate 1307.

Figure 14:
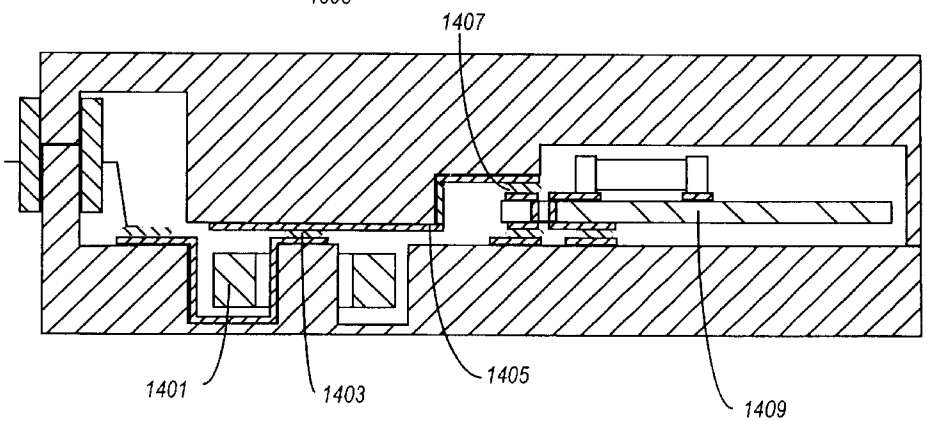
FIG. 14 shows a cross-sectional view of another embodiment of the multi-part reactive device.

FIG. 14 shows a cross-sectional view of another embodiment of the multi-part reactive device. This figure shows a two part molded interconnect device for captivating a magnetically-effective core member 1401. Similar to other embodiments the inductor is connected via a solder connection 1403. Reference number 1405 is a conductor that connects the inductor to a substrate 1409 via a solder connection 1407.

FIGS. 11–14 illustrate the versatility of molded interconnect devices in constructing low cost and simple inductors.

Surface mount and through hole substrate based embodiments are augmented by molded interconnect device embodiments. Each of these embodiments are suited for constructing devices ranging from simple inductors to complex filters. The embodiments are easily adaptable for high-power, high-frequency applications. Each of the embodiments replaces wire with conductive traces. This is a particularly powerful approach because it makes for simple assembly, compact geometry, structurally robust, and thermally efficient designs. The disclosed designs provide mechanical mounting sufficiently robust to withstand vibration intensive environments and to dissipate heat generated during use. The device also reduces sensitivity to skin effect at higher frequencies without the need for specialized wire or windings.

What is claimed is:

1. A multi-part reactive device comprising:

a substrate having a first conductive area and a second conductive area disposed thereon;

a first conductive element having a first terminal connected to the first conductive area, and a second terminal connected to the second conductive area, wherein a first current loop is formed extending from the first conductive area, through the first terminal, through the first conductive element, through the second terminal, to the second conductive area;

a magnetically-effective core member captivated by the first conductive element to the substrate between the first terminal and the second terminal and encircling the current loop wherein the first conductive area, the first conductive element, the magnetically-effective core member, and the second conductive area form a first magnetic circuit;

wherein the first conductive element comprises a surface-mountable component;

wherein the substrate has a major surface and an opposing major surface, the multi-part reactive device further comprising at least one via connecting the major surface to the opposing major surface, wherein the first conductive area is disposed on the first major surface coinciding with the at least one via and wherein the first terminal is connected to a portion of the first conductive area coinciding with the at least one via.

2. A multi-part reactive device in accordance with claim 1 wherein the magnetically-effective core member has a doughnut geometry with a first side and an opposing second side.

3. A multi-part reactive device in accordance with claim 2 wherein the first conductive element faces the first side of the magnetically-effective core member and the second conductive area faces the second side of the magnetically-effective core member.

4. A multi-part reactive device in accordance with claim 1 further comprising:

a thermally conductive baseplate connected to the at least one via coincident with the opposing major surface.

5. A multi-part reactive device comprising:

a substrate having a first conductive area and a second conductive area disposed thereon;

a first conductive element having a first terminal connected to the first conductive area, and a second terminal connected to the second conductive area, wherein a first current loop is formed extending from the first conductive area, through the first terminal, through the first conductive element, through the second terminal, to the second conductive area;

a magnetically-effective core member captivated by the first conductive element to the substrate between the first terminal and the second terminal and encircling the current loop wherein the first conductive area, the first conductive element, the magnetically-effective core member, and the second conductive area form a first magnetic circuit;

a third conductive area electrically connected to and extending apart from the second conductive area;

a fourth conductive area disposed on the substrate electrically isolated from the first conductive area, the second conductive area and the third conductive area;

a second conductive element having a third terminal connected to the third conductive area and a fourth terminal connected to the fourth conductive area, wherein the third conductive area, the second conductive element, the magnetically-effective core member, and the fourth conductive area form a second magnetic circuit coupled to the first magnetic circuit;

wherein the substrate has a first major surface and a second major surface opposing the first major surface, the multi-part reactive device further comprising:

at least one via connecting the major surface to the opposing major surface, wherein the first conductive area is disposed on the first major surface coinciding with the at least one via and wherein the first terminal is connected to a portion of the first conductive area coinciding with the at least one via.

6. A multi-part reactive device comprising:

a substrate having a first conductive area and a second conductive area disposed thereon;

a first conductive element having a first terminal connected to the first conductive area, and a second terminal connected to the second conductive area, wherein a first current loop is formed extending from the first conductive area, through the first terminal, through the first conductive element, through the second terminal, to the second conductive area;

a magnetically-effective core member captivated by the first conductive element to the substrate between the first terminal and the second terminal and encircling the current loop wherein the first conductive area, the first conductive element, the magnetically-effective core member, and the second conductive area form a first magnetic circuit;

a third conductive area electrically connected to and extending apart from the second conductive area;

a fifth conductive area disposed on the substrate electrically isolated from the first conductive area, and extending between the second conductive area, and the third conductive area;

a sixth conductive area disposed on the substrate electrically isolated from the fifth conductive area; and a capacitor connected between the fifth conductive area, and the sixth conductive area.

7. A multi-part reactive device comprising:

a substrate having a first conductive area and a second conductive area disposed on a first major surface and an opposing conductive area disposed on a second major surface opposing the first major surface, wherein the opposing conductive area is electrically connected to the second conductive area by at least one via, and wherein the opposing conductive area is at least in part coincident with the first conductive area;

a first conductive element having a first terminal connected to the first conductive area, and a second terminal, connected to the second conductive area, wherein a current loop is formed extending from the first conductive area, to the first terminal, to the first conductive element to the second terminal, to the second conductive area to the at least one via to the opposing conductive area; and a magnetically-effective core member captivated by the first conductive element to the substrate between the first terminal and the second terminal and encircling the current loop wherein the first conductive area, the first conductive element, the magnetically-effective core member, the second conductive area the at least one via and the opposing conductive area form a first magnetic circuit.

8. A multi-part reactive device in accordance with claim 7 wherein the first conductive element comprises a surface-mountable component.

9. A multi-part reactive device in accordance with claim 7 wherein the first conductive element comprises a through hole component, and wherein a portion of the first conductive element extends through the at least one via electrically connecting the second conductive area to the opposing conductive area.

10. A multi-part reactive device comprising:

a first molded thermoplastic device having a first conductive area disposed extending from a first surface to a fourth surface positioned apart from the first surface, and a second conductive area disposed extending from the first surface to a second surface positioned apart from the first surface, wherein the first conductive area and the second conductive area are electrically isolated;

a second molded thermoplastic device having major surface with a third conductive area and a fourth conductive area disposed thereon, wherein the third conductive area and the fourth conductive area are electrically isolated; and a magnetically-effective core member captivated between the first surface and the second surface by the second molded thermoplastic device, wherein a first portion of the first conductive area is connected to a first portion of the third conductive area and a first portion of the second conductive area is connected to a second portion of the third conductive area.

11. A multi-part reactive device in accordance with claim 10 wherein the first molded thermoplastic device further comprises a third surface, a fourth surface, and a fifth surface, wherein the first surface, the third surface, and the fifth surface are positioned in a substantially coplanar orientation, and the second surface and the fourth surface are positioned in a substantially coplanar orientation.

12. A multi-part reactive device in accordance with claim 11 wherein the first conductive area extends from the third surface to the fourth surface to the first surface, and the second conductive area extends from the first surface to the second surface to the fifth surface, wherein the major surface of the second molded thermoplastic device abuts the third surface, the fifth surface, and the first surface of the first molded thermoplastic device.

13. A multi-part reactive device in accordance with claim 12 wherein a second portion of the second conductive area is connected to a first portion of the fourth conductive area.

* * * * *